US006241440B1

(12) United States Patent
Orlebeke

(10) Patent No.: US 6,241,440 B1
(45) Date of Patent: Jun. 5, 2001

(54) DEVICE FOR TETHERING A FITTING TO A FLAT SURFACE

(75) Inventor: Steven Orlebeke, Pewaukee, WI (US)

(73) Assignee: Harken, Inc., Pewaukee, WI (US)

( * ) Notice: Subject to any disclaimer, the term of this patent is extended or adjusted under 35 U.S.C. 154(b) by 0 days.

(21) Appl. No.: 09/313,804

(22) Filed: May 18, 1999

Related U.S. Application Data

(60) Provisional application No. 60/089,242, filed on Jun. 15, 1998.

(51) Int. Cl.[7] ..... B60P 7/08

(52) U.S. Cl. ..... 410/106; 410/101; 410/110

(58) Field of Search ..... 410/101, 106, 410/110, 102, 116; 248/429; 24/265 CD, 115 K; 114/218; 224/563

(56) References Cited

U.S. PATENT DOCUMENTS

| | | | | |
|---|---|---|---|---|
| 1,321,742 | * | 11/1919 | Hendricks | 24/115 K |
| 3,106,377 | * | 10/1963 | Cotton | 410/116 |
| 3,142,264 | * | 7/1964 | DeBoer | 410/106 |
| 3,189,311 | * | 6/1965 | Hutchison | 410/101 X |
| 3,765,637 | * | 10/1973 | Watts | 410/116 |
| 3,779,502 | * | 12/1973 | Marberg | 410/116 |
| 4,295,765 | * | 10/1981 | Burke | 410/101 |
| 4,630,982 | * | 12/1986 | Ferner | 410/102 |
| 5,180,263 | * | 1/1993 | Flowers, Jr. | 410/106 |
| 5,456,443 | * | 10/1995 | Taaffe | 248/499 |
| 5,775,664 | * | 7/1998 | Martin | 410/101 X |

FOREIGN PATENT DOCUMENTS

| | | | | |
|---|---|---|---|---|
| 2254363A | * | 10/1992 | (GB) | 224/563 |

OTHER PUBLICATIONS

Harken 1998 Catalog, p. 60, Item c2805, Jan. 1998, Harken Co., Pewaukee, WI; as described on attached IDS Section Statement as to Item Illustrated in Publication.

* cited by examiner

*Primary Examiner*—Stephen T. Gordon
(74) *Attorney, Agent, or Firm*—Pyle & Piontek

(57) ABSTRACT

A tethering device for anchoring a tether has a cup rotatably held within a cylinder, with the cylinder mounted approximately flush in a flat surface, such as a boat deck. A loop of fibrous material, such a strap, has a first end removably anchored in the cup by passing around an anchoring pin. A second fibrous loop end is exposed above the deck surface for tethering a block, fitting, or the like. The tethering device provides for a low profile tether anchor, for rotation of the loop, and is water tight to prevent water flow through the device.

15 Claims, 3 Drawing Sheets

DEVICE FOR TETHERING A FITTING TO A FLAT SURFACE

CROSS REFERENCE

The present invention claims the benefit of prior U.S. Provisional Application No. 60/089,242; filed Jun. 15, 1998.

FIELD OF THE INVENTION

The present invention is related to devices for tethering fittings to a deck or the like.

BACKGROUND OF THE INVENTION

Pulleys or blocks are employed on sailing vessels to carry and transfer loads imposed on the sails and enable adjustments of the sails. Since the loads on certain fittings can be very high, such fittings are normally attached with the use of heavy duty shackles or posts made from stainless steel.

Recent developments in fiber technology have led to flexible lines and woven fabrics having extremely high tensile strengths. The use of such high strength fibrous materials in applications such as tethering boat fittings to a deck, however, has certain disadvantages associated with it. As an example, it is desirable to have such fittings be rotatable. Tethering a fitting snugly with a fiber cord or strap, however, does not allow for rotation.

In addition, it is desirable to have fittings as close to the deck as possible to give the boat a low center of gravity, as well as to reduce clutter. However, it is difficult to tether a fitting close to the deck with a fibrous material such as a cord or strap, as the cord must be tied to a cleat or other fitting on the deck, and then to the fitting above. This is a particularly acute problem should rotation of the fitting be desired, in which case a sufficient length of line must be provided in the line.

There is therefor an unresolved need in the industry for a fitting tethering device.

OBJECTS OF THE INVENTION

It is an object of the invention to provide a device for tethering a fitting or the like to a substantially flat surface, such as a deck.

It is a further object to provide a tethering device capable of swiveling or rotating generally about a vertical axis.

It is a still further object of the invention to provide a through-deck tethering device which is water tight.

SUMMARY OF THE INVENTION

The present invention comprises a tethering device for anchoring a tether line, cord, or strap, with the device attached to a substantially flat surface, such as a deck or the like. An outer cylinder is mounted in the flat surface, and an inner cup is rotatably held in the outer cylinder. Fibrous material, such as rope or strap, is removably anchored to the inner cup.

Preferably, the inner cup has a lower flange which rotatably contacts the bottom rim of the outer cylinder, and the fibrous material is looped, with one end of the loop around a locking pin. The preferred locking pin has a length greater than the diameter of the inner cup, with the end of the loop around the pin thereby locked in place and prevented from passing through the cup. A second end of the loop is above the flat surface for tethering a fitting or the like. As loads are applied to the loop upwards and away from the cup, the inner cup lower flange holds the cup in place in the outer cylinder, although the cup and hence the anchored loop remain free to rotate.

A collar around the top of the inner cup rotatably contacts the outer cylinder top rim to prevent the cup from passing downwards through the cylinder. The fibrous material is preferably high strength cordage or strapping, preferably comprised of thermoplastic filaments.

The above brief description sets forth rather broadly the more important features of the present disclosure so that the detailed description that follows may be better understood, and so that the present contributions to the art may be better appreciated. There are, of course, additional features of the disclosure that will be described hereinafter which will form the subject matter of the claims appended hereto. In this respect, before explaining the several embodiments of the disclosure in detail, it is to be understood that the disclosure is not limited in its application to the details of the construction and the arrangements set forth in the following description or illustrated in the drawings. The present invention is capable of other embodiments and of being practiced and carried out in various ways, as will be appreciated by those skilled in the art. Also, it is to be understood that the phraseology and terminology employed herein are for description and not limitation.

DETAILED DESCRIPTION

Figure 1:
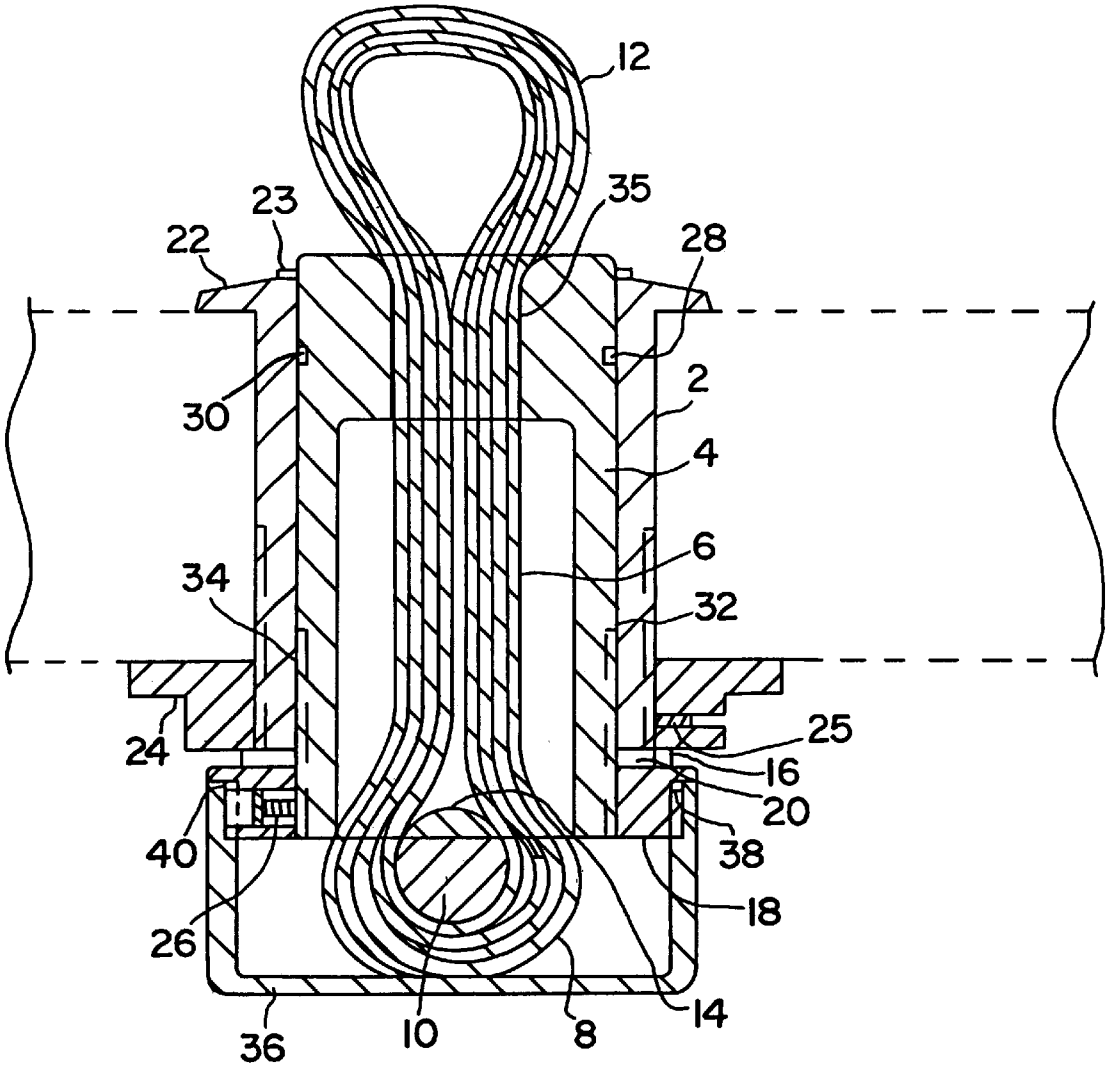
FIG. 1 is a cross section view of a preferred embodiment of tether device of the invention.

Turning now to the drawings, FIG. 1 is a cross section of a preferred tether device of the invention. Outer cylinder 2 is mounted in a flat surface (shown in broken line) having a top and a bottom, which may for example be a boat deck. Inner cup 4 is rotatably and removably held in outer cylinder 2, with a loop of high strength fibrous webbing 6 removably anchored therein.

Webbing 6 is preferably low stretch, low creep, and low water absorption strap comprised of thermoplastic polymer filaments. Although the invention may be practiced with a wide variety of webbing having different dimensions, web widths on the range of from about 0.5 to 1.75 inch, with a thickness in the range of 0.02–0.06 inches have been found to be useful. In particular, a web with a 1" width, 0.05" thickness, and comprised of "Spectra", an Allied Signal trade name for polyolefin fibers has been found to be advantageous. The breaking strength of this 1" webbing is 7,000 lbs. Other suitable webs include, but are not limited to, those comprised of Kevlar, a DuPont trade name for polyolefin fibers. The device of the invention may be scaled to utilize webs of different sizes. In addition to webbing, the invention may of course likewise be practiced using cords or ropes.

Web loop 6 is anchored in place by wrapping a first end 8 around locking pin 10, and has a second end 12 exposed above the deck for tethering a fitting or the like. After being tethered to a fitting or the like (not illustrated), webbing 6 is preferably sewn in place to create the loop illustrated.

Locking pin 10 preferably has a length that is wider than the inside diameter of cup 4, so that once wrapped with web loop 6 it cannot pass upwards through cup 4. Locking pin 10 is preferably unattached for ease of installation of webbing 6, but other embodiments of the invention may include a locking pin attached to the inner cup, either at the cup bottom rim or in the interior of the cup. A preferred material of construction for locking pin 10 is stainless steel for its corrosion resistance, durability, and strength.

Figure 2A:
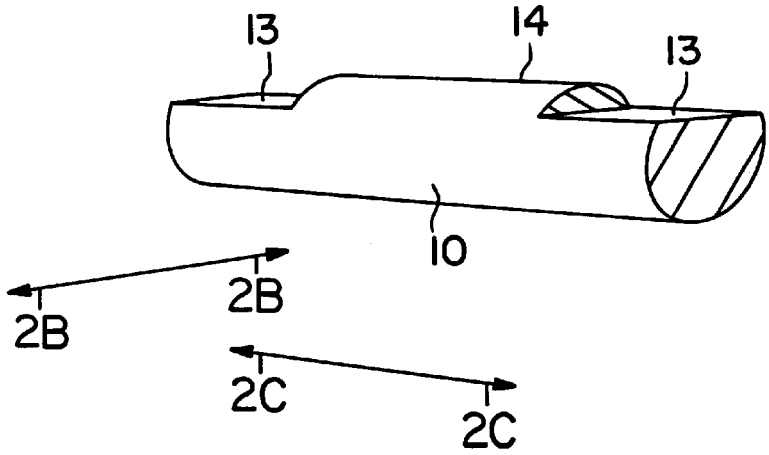
FIG. 2A is a perspective view of a preferred embodiment of the locking pin of the invention.
Figure 2B:
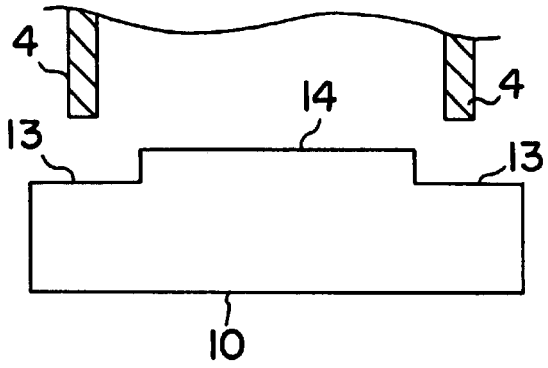
FIG. 2B is a side view, shown partially in cross section, of the preferred embodiment of the locking pin of the invention below the inner cup of the invention.
Figure 2C:
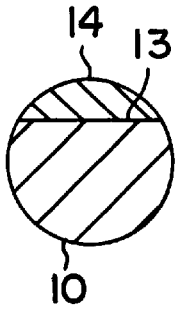
FIG. 2C is an end view of the preferred locking pin of the invention.

FIGS. 2A, 2B, and 2C illustrate various views of preferred locking pin 10. In the perspective view of FIG. 2A, flats 13 on either end of pin 10 are shown, with raised center portion 14 therebetween. As illustrated in FIG. 2B, flats 13 are spaced to contact the outer rim of inner cup 4, with center portion 14 held within the circumference of cup 4. Thus center portion 14 provides for centering pin 10 within cup 4 circumference, and also provides for locking pin 10 within cup 4 circumference. FIG. 2C illustrates an end view of pin 10 along the line 2C—2C of FIG. 2A With the preferred locking pin loose and unattached to the inner cup, care must be taken during assembly of the web loop so that the pin does not loosen or release from the loop end.

Cylinder 2 has a bottom rim 16, and inner cup 4 has an annular flange 18. Cup flange 18 rotatably abuts cylinder rim 16, with polymer washer 20 therebetween for reduced friction to ease rotation of cup 4 in cylinder 4. A preferred polymer washer 20 is made out of Torlon 4347, an Amoco poly(amide-imide) molding resin thermoplastic material that offers high strength and a low surface coefficient of friction. Outer cylinder 2 has top flange 22 abutting the top of the deck in which cylinder 2 is mounted. Cup 4 has collar 23 around its top that rotatably contacts the top of cylinder 2 to rotatably support cup 4 in cylinder 2. As the loads on strap 6 are in the substantially upwards direction away from the deck top, collar 23 is not required to be of as substantial construction as cup flange 18. Collar 23 is preferably a removable snap ring fit about an annular groove around the top of cup 4. Removal of collar 23 allows for cup 4 to be removed from below deck if desired.

Cylinder 2 is removably mounted in the deck by backing nut 24, which is threadably and adjustably attached to the bottom of cylinder 2. Because backing nut 24 is adjustable, cylinder 2 may advantageously be mounted in different decks of varying thickness'. Backing nut 24 has adjustable lock screw 25 for locking it in place to prevent loosening by vibration. Inner cup 4 and cylinder 2 may be cut to shorten them as required to adjust their length for decks of different thickness'. Inner cup flange 18 is preferably threadably attached to cup 4 to facilitate the cutting of cup 4, and to thereby facilitate the use of cup 4 with decks of varying thickness'. To removably lock flange 18 in place and prevent loosening from vibration, flange has set screw 26 operable against cup 4.

When used on a boat deck to tether fittings, it is required that the device of the invention be substantially sealed against moisture passing through it. To accomplish this, elastomer o-ring 28 seated in cup outer wall annular groove 30 is rotatably operable against cylinder inner wall 32. This prevents water from passing between cup outer wall 34 and cylinder inner wall 32. Also, web loop 6 passes through guide slot 35 in the mouth of cup 4 tightly so that moisture passing into cup 4 is minimized. Sealants such as petroleum jelly, putties, silicones, or elastomers may also be applied to web 6 center portion in slot 35 to further prevent passage of moisture. What moisture does pass into cup 4 is prevented from escaping below deck into a boat hull by removable bottom cap 36 which is threadably attached to cup flange 18, with elastomer o-ring 38 seated in an annular groove 40 between flange 18 and cap 36 for sealing.

Figure 3:
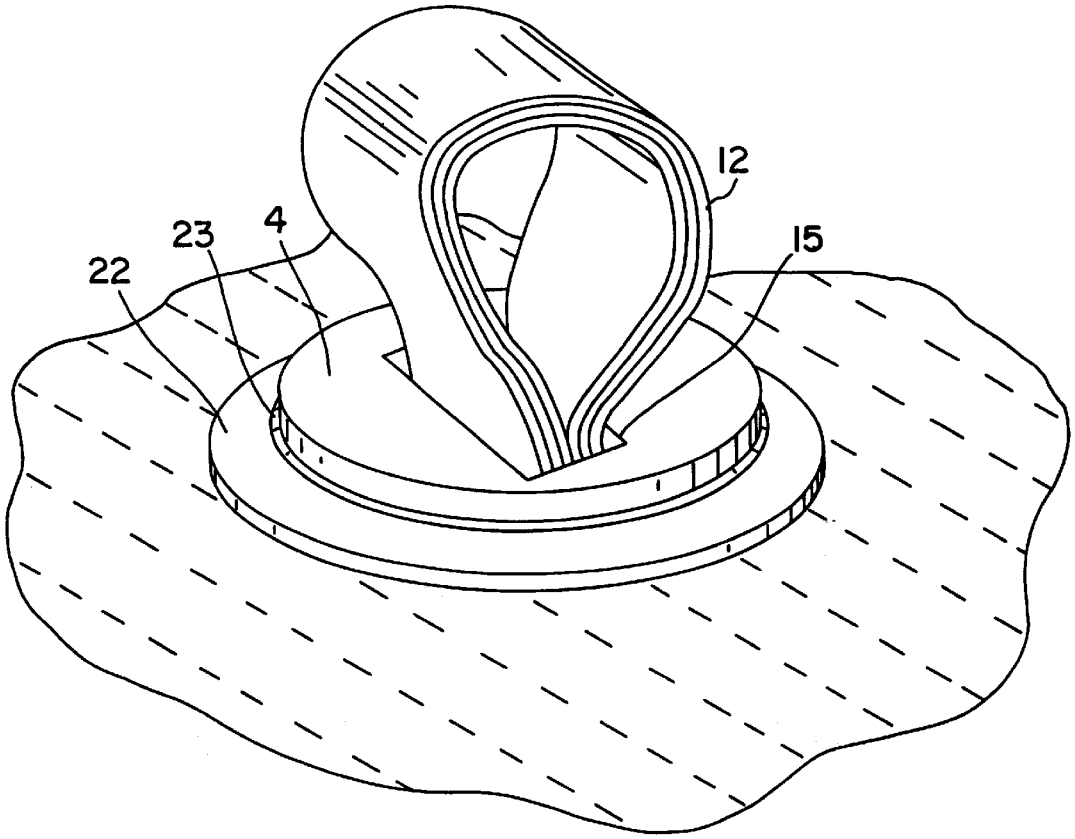
FIG. 3 is a perspective view of the top portion of the preferred embodiment of the invention installed in a deck.

FIG. 3 shows a perspective view of strap loop second end 12 extending out from slot 15 in cup 4, and exposed above a deck surface (shown in broken line). Cylinder flange 22 and cup collar 23 are also shown.

Preferred materials of construction for the components of the device of the invention include aluminum for the cup, cylinder, and all flanges. Aluminum is preferred for its combination of strength and light weight. Other materials could include stainless steel or high strength plastics.

The tethering device of the invention thus offers the valuable advantages of providing an anchoring means that has a low profile, that is rotatable, that may be used with decks of different thickness', and that is sealed against water passing through it into a hull.

The advantages of the disclosed invention are thus attained in an economical, practical, and facile manner. While a preferred embodiment and example configuration have been shown and described, it is to be understood that various further modifications and additional configurations will be apparent to those skilled in the art. In particular, although illustrated and described as being used on a boat for tethering a fitting or the like to a deck, the present invention as claimed is not limited to such use. It is intended that the specific embodiment and configuration herein disclosed is illustrative of the preferred and best mode for practicing the invention, and should not be interpreted as limitations on the scope of the invention as defined by the appended claims.

What is claimed is:

1. A tethering device for anchoring a tether, the device attached to a substantially flat surface, the device comprising:

a) an outer cylinder mounted in the substantially flat surface; said cylinder having a bottom;

b) an inner cup rotatably held in said outer cylinder; said inner cup having an annular cup flange rotatably contacting said cylinder bottom; said inner cup having a locking pin; and c) fibrous material comprising a loop, one end of said loop wrapped about said locking pin, whereby said locking pin removably locks said loop to said inner cup; a second end of said loop exposed above the substantially flat surface.

2. A tethering device as in claim 1, wherein said inner cup has a diameter and a bottom rim, and wherein said locking pin has a length greater than said cup diameter, said pin has a flat portion proximate each end of said locking pin, said flat portions for abutting said cup bottom rim.

3. A tethering device as in claim 1, further comprising a bottom cap threadably attached to said cup flange for capping an end of said cup.

4. A tethering device as in claim 3, further comprising elastomer sealing means between said bottom cap and said cup flange.

5. A tethering device as in claim 1, further comprising bearing means between said cup flange and said outer cylinder bottom.

6. A tethering device as in claim 5, wherein said bearing means comprise a polymer washer.

7. A tethering device as in claim 1, wherein said cup flange is threadably and adjustably attached to said inner cup.

8. A tethering device as in claim 7, further comprising an adjustable set screw for locking said adjustable cup flange in place on said cup.

9. A tethering device as in claim 1, wherein said locking pin is attached to said inner cup.

10. A tethering device for anchoring a tether, the tethering device attached to a substantially flat surface having a bottom and a top, the device comprising:

a) an outer cylinder mounted in the substantially flat surface; said outer cylinder having an inside wall; said outer cylinder having an upper flange abutting the top of the substantially flat surface; said outer cylinder having a cylinder bottom; a backing nut threadably and adjustably attached to said cylinder and abutting the bottom of the substantially flat surface;

b) an inner cup rotatably and removably held in said outer cylinder, said inner cup having a top, having a flange rotatably contacting said cylinder bottom, an annular collar around said inner cup top rotatably contacting said cylinder upper flange; said inner cup having an outside wall, an annular groove in said cup outside wall with an elastomer o-ring seated therein, said elastomer o-ring in sealing contact with said cylinder inside wall, said inner cup having a removable bottom cap covering an end of said inner cup;

c) a high strength fibrous tether loop, a first end of said loop passing around a locking pin, said locking pin held in place by said inner cup, whereby said strap loop first end is locked in place, a center portion of said strap loop passing through said inner cup, and a second end of said loop exposed above the substantially flat surface.

11. A tethering device for anchoring a tether, the device attached to a substantially flat surface, the device comprising:

a) an outer cylinder mounted in the substantially flat surface; said outer cylinder having an upper end and a top flange abutting the substantially flat surface;

b) an inner cup rotatably held in said outer cylinder; said inner cup having a top annular rim, said inner cup having a collar around and proximate said cup top rim, said collar rotatably contacting said outer cylinder upper end; and c) fibrous material removably anchored to said inner cup.

12. A tethering device as in claim 11, wherein said collar comprises a removable snap ring snap fit into an annular groove around said inner cup top.

13. A tethering device for anchoring a tether, the tethering device attached to a substantially flat surface having a bottom and a top; the device comprising:

a) an outer cylinder fixedly mounted in the substantially flat surface; said outer cylinder having an upper flange abutting the top of the substantially flat surface, said outer cylinder having a cylinder bottom, said outer cylinder having a backing nut threadably and adjustably attached thereto and abutting the bottom of the substantially flat surface, said outer cylinder having an inside wall, said outer cylinder comprised of aluminum;

b) an inner cup rotatably and removably held in said outer cylinder, said inner cup having a top, said inner cup having an annular bottom flange for rotatably contacting said cylinder bottom, with a polymer washer held therebetween, said annular bottom flange threadably and adjustably attached to said inner cup, a bottom cap threadably attachable to said bottom flange for sealing an end of said inner cup, an elastomer seal operable between said bottom cap and said annular bottom flange; said inner cup having a guide slot, a removable snap fit collar snap fit into a first annular groove around said inner cup top, said snap fit collar rotatably contacting said outer cylinder upper flange, said inner cup having an outside wall, a second annular groove in said outside wall with an elastomer o-ring seated therein, said o-ring in sealing contact with said outer cylinder inside wall, said inner cup having a bottom rim and a diameter, said inner cup comprised of aluminum;

c) a locking pin having a length greater than said inner cup diameter, said locking pin having two flat portions proximate respective ends of said pin for abutting said inner cup bottom rim, said locking pin comprised of steel; and d) a high strength strap loop comprised of thermoplastic polymer filaments, a first end of said loop passing around said locking pin and urging said locking pin against said inner cup bottom rim, said first loop end thereby prevented from passing through said inner cup and held in place proximate said inner cup, a center portion of said loop passing through said inner cup guide slot, a second end of said loop exposed above the substantially flat surface.

14. A tethering device for anchoring a tether, the device attached to a substantially flat surface, the device comprising:

an outer cylinder mounted in the substantially flat surface; an inner cup rotatably held in said outer cylinder; said outer cylinder having an inside wall and said inner cup having an outside wall, elastomer sealing means between said cylinder inside wall and said cup outside wall; and fibrous material removably anchored to said inner cup.

15. A tethering device as in claim 14, wherein said inner cup outside wall having an annular groove, and wherein said sealing means comprise an elastomer o-ring seated in said groove and in sealing contact with said outer cylinder inside wall.

* * * * *